United States Patent [19]

Doyen

[11] Patent Number: 4,694,533

[45] Date of Patent: Sep. 22, 1987

[54] HINGE AND SECTIONAL PANELS ON A FRAME ENABLING ASSEMBLY AND DISASSEMBLY THEREOF

[75] Inventor: Gérard Doyen, Beuvrages, France

[73] Assignee: Alsthom, Paris, France

[21] Appl. No.: 907,343

[22] Filed: Sep. 15, 1986

[30] Foreign Application Priority Data

Sep. 23, 1985 [FR] France ..... 85 14069

[51] Int. Cl.[4] ..... E05D 7/10

[52] U.S. Cl. ..... 16/257; 16/223; 16/261; 16/356

[58] Field of Search ..... 16/225, 252, 254, 259, 16/260, 261, 263, 270, 355, 356, 380, 258, 223, 271, 257

[56] References Cited

U.S. PATENT DOCUMENTS 3,863,372 2/1975 Stilling ..... 16/355
3,921,253 11/1975 Nelson ..... 16/257
4,406,379 9/1983 Anderson ..... 16/356

FOREIGN PATENT DOCUMENTS 945547 1/1964 United Kingdom ..... 16/261

*Primary Examiner*—Nicholas P. Godici
*Assistant Examiner*—G. M. Reid
*Attorney, Agent, or Firm*—Sughrue, Mion, Zinn, Macpeak, and Seas

[57] ABSTRACT

The hinge enabling articulation of sectional panels (30) on a frame (10) consisting of a lip (11) forming swivel pin, integral with the frame, and at least one retaining member (20), such retaining member being fitted onto a projecting part (12) of the frame and held in place by a flexible blade (23) having a catch thereon which snaps into a groove (13) in the projecting part, each sectional panel (30) terminating at the hinge in a substantially semi-circular trough (31) guided between the lip (11) and a rounded portion (27) of the retaining member (20) located opposite said lip, features a hand releasing tab (25) made integral with the flexible blade (23) and projecting outside the retaining member (20).

1 Claim, 2 Drawing Figures

HINGE AND SECTIONAL PANELS ON A FRAME ENABLING ASSEMBLY AND DISASSEMBLY THEREOF

This invention concerns a hinge enabling articulation of sectional panels on a frame, the said sectional panels serving in particular as access doors or panels to various mechanisms of a railway vehicle.

BACKGROUND OF THE INVENTION

The prior art teaches such a type of hinge consisting of a lip forming a swivel pin (ie. the hinge pin) integral with the frame, and at least one retaining member, such retaining member being installed on a projecting part of the frame and held in place by a flexible blade snapped into a groove of the projecting part, the end portion of a sectional panel being substantially semicircular and being guided between the lip and a rounded portion of the retaining member opposite said lip.

This type of hinge is very easy to implement, as such consists in placing the end of the sectional panel on the lip and in snapping in one or more retaining members along the length of the hinged panel.

However, in dismantling a panel, this type of hinge requires some tooling to unsnap the retaining members and very often such disassembling destroys the flexible blade and requires replacement of the retaining members.

The object of the present invention is to enable manual disassembly of the retaining members and refitting of the panel with the same retaining members by avoiding destruction of the flexible blade.

This object is attained by the provision of a manual releasing tab made integral with the flexible blade.

Advantageously, the tab is actuated within a cutout in the retaining member.

A hinge according to the invention will now be described by way of example and with reference to the appended drawings.

DESCRIPTION OF THE PREFERRED EMBODIMENT

Figure 1:
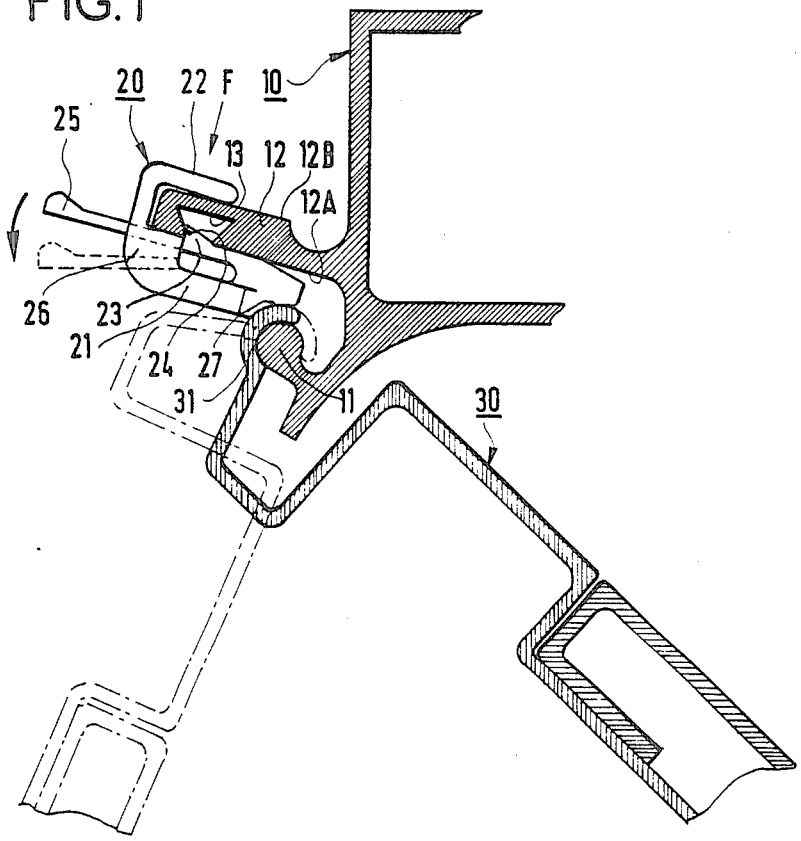
FIG. 1 shows the hinge according to the invention and a sectional panel articulated about said hinge.

In FIG. 1 is shown the frame 10, the retaining member 20 and the sectional panel 30.

The frame 10 comprises an integral lip 11 forming a cylindrical swivel pin over approximately three-fourths of its circumference, and a integral projecting part 12 comprising two parallel faces 12A and 12B and a dovetail-shaped opening 13 within the face 12A proximate to said lip 11.

The retaining member 20 comprises a body 21 and a C-shaped lug 22, enabling fitting of the retaining member lug to the projecting part 12 of the frame 10, and a flexible blade 23 comprising a projecting catch 24 which engages with the dovetail 13 within the face 12A of the projecting part 12, a releasing tabe 25 made integral with the flexible blade 23 which extends along face

12A of the projecting part 12, a cutout 26 made in the body 21 through which the blade 23 passes and enabling movement of the tab 25 to unsnap or release the catch 24, and lastly a rounded concave edge portion 27 located opposite the lip 11.

The sectional panel 30 ends in a semi-circular trough 31 which engages between the lip and the rounded concave edge portion 27 of the retaining member 20.

Figure 2:
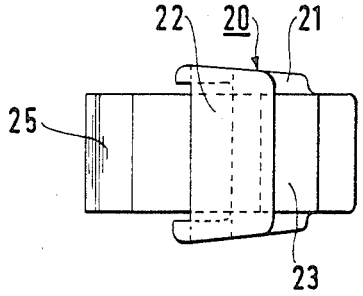
FIG. 2 shows a retaining member viewed according to the direction of arrow F in FIG. 1.

FIG. 2 clearly shows the shape of the tab 25 and its position within the retaining member.

A sectional panel is swivelably fitted to a frame as follows:

(1) Place the trough 31 of the sectional panel 30 on the lip 11 of the frame 10.

(2) Install one or more retaining members along the length of the hinge by engaging each member over the projecting part 12 of the frame 10 so that the catch 24 on the flexible blade 23 snaps into the dovetail opening 13.

This completes fitting of a sectional panel.

The sectional panel can be held up in any given open position by means of any suitable prop or stay for example.

A sectional panel is dismantled as follows:

Simply release the catch in each retaining member by pressing down on the tab 25 and remove the retaining members so released. The disassembly operation is thus very quick, requires no tools and does not damage the retaining members.

Without departing from the scope of the invention, this hinge can be adapted to all types of sectional panels and standardization of the lip would enable using a same retaining member for all sectional panels.

What is claimed is:

1. A hinge comprising, in combination, a sectional panel, a frame, said frame including a projecting lip of semicircular cross section forming a swivel pin and an integral projecting part extending generally in the same direction as the lip and being spaced therefrom, a sectional panel terminating at one end in a semicircular trough engaging said lip and forming a hinge connection therewith, and at least one retaining member installed on said projecting part, said projecting part including a groove on a face thereof proximate to said lip, said retaining member including a C-shaped lug, enveloping the end of said projecting part, said retaining member including a body having a concave rounded edge abutting said semicircular trough and further including an integral flexible blade extending along a face of said part proximate to said lip and including a catch facing said groove and being snap fitted into said groove by deflection of said flexible blade during engagement of the C-shaped lug with the end of the projecting part of said frame, wherein said flexible blade extends beyond the C-shaped lug, to define a hand releasing tab for forceably deflecting said flexible blade to release said catch from said groove, and wherein said retaining member body is cut out at its center and said flexible blade projects through said cutout from the rounded concave edge of said retaining member body to beyond said C-shaped lug.

* * * * *